US006460724B1

(12) United States Patent
Bradford

(10) Patent No.: US 6,460,724 B1
(45) Date of Patent: Oct. 8, 2002

(54) TOTE BOX WITH INTERENGAGING TOP RAIL

(75) Inventor: Judson A Bradford, Holland, MI (US)

(73) Assignee: Bradford Company, Holland, MI (US)

( * ) Notice: Subject to any disclaimer, the term of this patent is extended or adjusted under 35 U.S.C. 154(b) by 0 days.

(21) Appl. No.: 09/832,472

(22) Filed: Apr. 11, 2001

(51) Int. Cl.[7] ..... B65D 5/00
(52) U.S. Cl. ..... 220/642; 220/6; 220/7
(58) Field of Search ..... 220/642, 6, 7; 217/13

(56) References Cited

U.S. PATENT DOCUMENTS

| | | | | |
|---|---|---|---|---|
| 249,561 | A | | 11/1881 | Weston |
| 544,525 | A | | 8/1895 | Bartlett |
| 825,523 | A | | 7/1906 | Dewey |
| 959,734 | A | | 5/1910 | Hall |
| 1,046,018 | A | | 12/1912 | Reber |
| 2,191,291 | A | * | 2/1940 | Smith ..... 220/642 X |
| 2,304,853 | A | | 12/1942 | Shaw |
| 2,496,965 | A | | 2/1950 | Swingle |
| 3,156,370 | A | * | 11/1964 | Monfort ..... 220/6 X |
| 3,220,633 | A | | 11/1965 | Swane |
| 3,223,309 | A | | 12/1965 | Chiorri |
| 3,226,008 | A | | 12/1965 | Chiorri |
| 3,989,397 | A | | 11/1976 | Baker |
| 4,172,623 | A | | 10/1979 | Anderson |
| 4,210,274 | A | | 7/1980 | Leonard |
| 4,619,365 | A | | 10/1986 | Kelly et al. |
| 4,624,380 | A | * | 11/1986 | Wernette ..... 220/6 X |
| 4,712,942 | A | | 12/1987 | Brown |
| 4,720,013 | A | | 1/1988 | Nichols et al. |
| 4,971,201 | A | | 11/1990 | Sathre |
| 5,033,669 | A | | 7/1991 | Federico |
| 5,037,027 | A | | 8/1991 | Nichols |
| 5,119,950 | A | | 6/1992 | Takemura |
| 5,295,632 | A | | 3/1994 | Zink et al. |
| 5,335,789 | A | | 8/1994 | Taravella et al. |
| 5,337,950 | A | | 8/1994 | Bower |
| 5,377,857 | A | | 1/1995 | Taravella et al. |
| 5,462,221 | A | | 10/1995 | Zink et al. |
| 5,520,477 | A | | 5/1996 | Fink |
| 5,531,326 | A | | 7/1996 | Hummel et al. |
| 5,538,153 | A | * | 7/1996 | Marovskis et al. ..... 220/7 X |

FOREIGN PATENT DOCUMENTS

| | | |
|---|---|---|
| GB | 2 277 731 | 11/1994 |

* cited by examiner

*Primary Examiner*—Steven Pollard

(57) ABSTRACT

A tote box is disclosed which incorporates a box, four corner enhancers and a top rail which is secured over the top edge of the erected walls of the box. In one embodiment, the box walls are held together with the corner enhancers and top rail without the benefit of any mechanical fasteners such as rivets or the like. The top rail is secured onto the box by an inwardly extending hook on one of the channel side walls which engages grooves formed in the box walls. The top rail has a vertical lip which facilitates stacking multiple tote boxes.

27 Claims, 9 Drawing Sheets

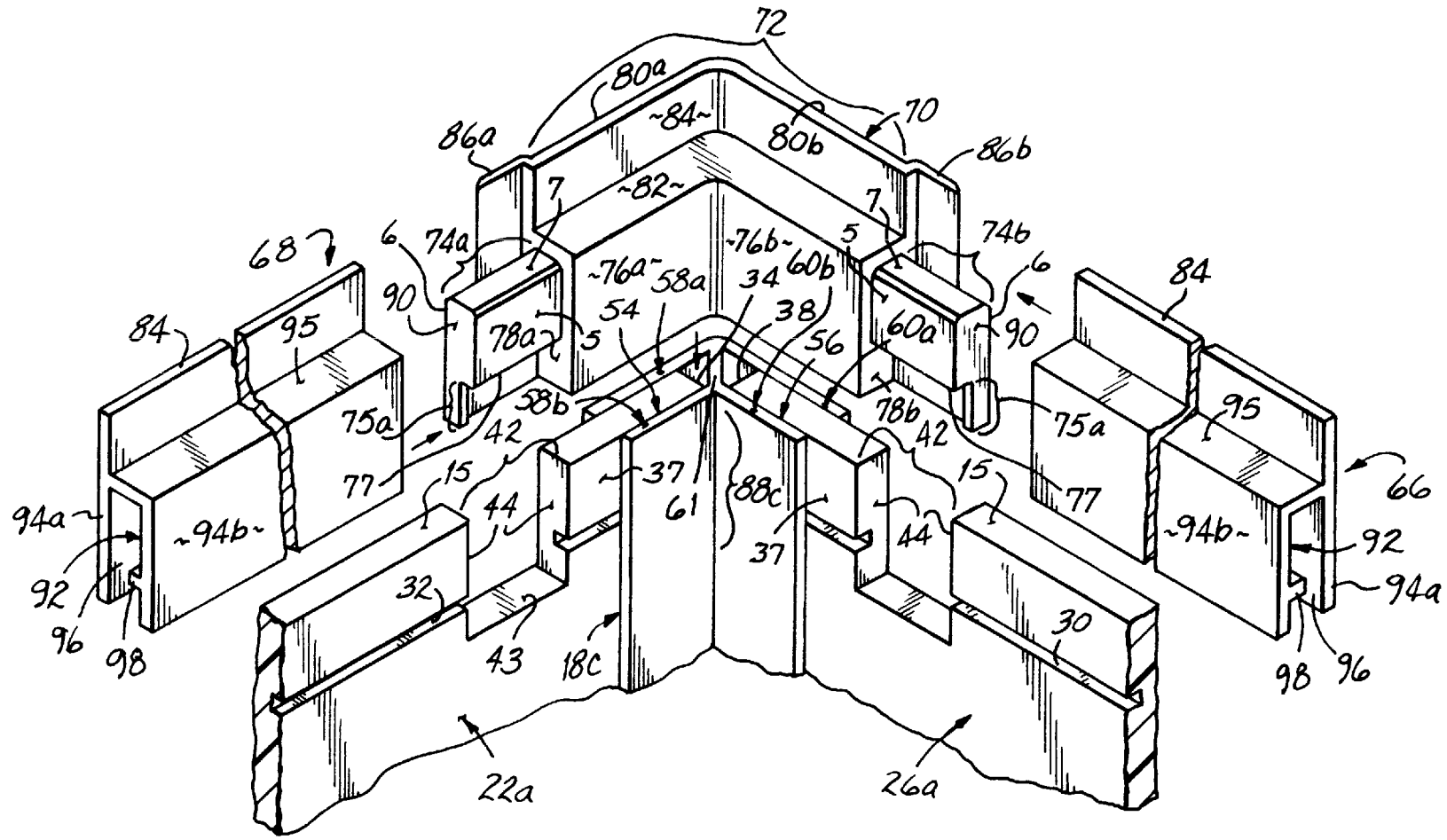
FIG. IB

TOTE BOX WITH INTERENGAGING TOP RAIL

FIELD OF THE INVENTION

This invention relates to tote boxes and more particularly to tote boxes made from foldable box blanks and having self locking top rails to hold the blanks in an erected, assembled relationship.

BACKGROUND OF THE INVENTION

Containers which are returnable/reusable are useful for the transportation, storage, and display of goods in commerce. Such containers, commonly called tote boxes, must be of sufficiently rigid construction to enable safe and damage free transport and storage of goods contained therein. These tote boxes are frequently designed so as to be stacked or mounted in a nesting relation for convenient transportation or storage of the tote boxes. In order to be stackable, the upper edge of the tote box is typically reinforced with a top rail or rim member which is adapted to receive another tote box stacked thereupon.

It is conventional to use a variety of materials for the construction of such tote boxes. Such materials typically consist of corrugated paperboard, corrugated plastic sheet, sheet metal and other such materials which are not sufficiently rigid to support a number of filled tote boxes in stacked relation. Therefore, it is also conventional to reinforce the corners of the tote boxes with structural supports so that a lower tote box of a stack of tote boxes can adequately support the load of the upper tote boxes and goods therein without deformation, possibly resulting in damage to the goods contained therein.

Typically these tote box corner supports and top rails require additional fasteners such as rivets, staples, screws or the like to secure the top rail and the corner support to the box itself. These fasteners add material costs and manufacturing steps to the construction of the tote box thereby resulting in an expensive and difficult to assemble tote box.

One patent which discloses a tote box having corner supports and a top rail which are not held in place with additional fasteners such as rivets, staples, screws or the like is applicant's U.S. Pat. No. 5,295,632. However, in both embodiments of tote box disclosed in this patent, the tote box blank must have end flaps in order to hold the corner supports in place. The use of end flaps requires additional material to form the box blank, resulting in additional cost to manufacture the tote box.

Additionally in applicant's U.S. Pat. No. 5,295,632 a unitary top rail is locked over the top edge of the tote box with tabs folded downwardly from the upper edges of the box walls. The tabs engage a hook formed on one of the channel side walls of the top rail. Use of such tabs to lock the top rail onto the top edge of the erected box requires that the width of the downwardly open channel of the top rail be at least twice the thickness of the box blank. Additionally, the thickness of the box blank is limited to material thin enough to fold the material approximately 180° to form the tabs extending downwardly from the upper edges of the box walls.

Accordingly, it is a primary objective of the present invention to provide a tote box made from a foldable material too thick to accept a full 180° fold but so constructed that the folded box blank, top rail and corner enhancers may be assembled without any fasteners and with a minimum of assembly steps and space.

Another objective of this invention has been to provide a tote box which meets the primary objectives set forth hereinabove and which facilitates the stacking of additional tote boxes thereon without deformation of the tote box.

A further object of the present invention has been to provide a tote box having a self-locking top rail securable to a box made of material of substantial thickness which need not be folded over upon itself to create rail locking tabs.

SUMMARY OF THE INVENTION

The present invention is directed to a tote box which is assembled from a foldable box blank, corner enhancers and a self-locking top rail. When folded into the appropriate shape, the box blank is erected into a box having a bottom, two opposed end walls, and two opposed side walls. The end walls and side walls have upper edges defining a top edge of the box. At least two opposed walls each have a groove extending horizontally below the upper edge of the respective box wall. In one preferred embodiment each box wall has a continuous groove extending the length of the respective wall. A pair of opposed walls preferably have holes into which reinforcing hand holds may be inserted to aid in manual handling of a loaded tote box. The box blank is preferably die cut but may be otherwise formed.

To hold the erected box blank in an assembled relationship and to reinforce the top edge of the tote box, a channel shaped top rail extends around the top edge of the tote box. In one embodiment of the present invention, the top rail comprises multiple pieces including a pair of side pieces, a pair of end pieces and four corner pieces. The side pieces are of a first length and the end pieces of a second length, the first length being greater than the second length typically. However, the side and end pieces may be of an identical length. The side and end pieces of the top rail are preferably manufactured from extruded plastic or aluminum. However, these pieces may be constructed of other materials such as steel, for example.

Each of the side and end pieces of the top rail has a downwardly open channel formed between a pair of channel side walls. At least one of the channel side walls has an inwardly extending hook. The inwardly extending hook may be located at the bottom of the channel side wall or spaced upwardly from the bottom of the channel side wall. The downwardly open channel of each of the side and end pieces of the top rail has a width approximately equal to the thickness of the box blank. When the downwardly open channel of the top rail piece is pushed down over the upper edge of one of the erected box walls, the inwardly extending hook engages the groove formed in the box wall, thereby locking the top rail piece over the upper edge of the tote box wall. The side and end pieces of the top rail are also engaged with the corner pieces of the top rail to form a continuous top rail locked over the top edge of the box as the result of the engagement of the inwardly extending hooks of at least two top rail pieces with the grooves of at least two opposed box walls.

The inwardly extending hooks of at least two top rail pieces engage the grooves of at least two box walls thereby securing the top rail over the top edge of the tote box without the need for further fasteners such as screws, rivets, or staples. The side and end pieces of the top rail preferably have a vertical lip which extends upwardly from the rail piece. The vertical lip enables nested stacking of additional tote boxes. A first or upper tote box may be nestably stacked on a second or lower tote box by placing the bottom of the first or upper tote box within the vertical lip of the top rail of the second or lower tote box.

The corner pieces of the top rail are preferably made of molded plastic but may be made of other materials. The corner pieces preferably have a vertical lip like the side and end pieces of the top rail but may lack the lip. Each of the inwardly extending hooks of the side and end pieces of the top rail snaps beneath a portion of the corner pieces of the top rail, further securing the multiple pieces of the top rail together.

Structural corner enhancers reside at each corner of the tote box to hold the erected side and end walls together in an assembled relationship and to stiffen the tote box corners. The corner enhancers provide a load path for the weight of the stacked tote boxes and their contents to be distributed downwardly and thereby provide structural integrity to the tote box and prevent side and end wall deformation. Each corner enhancer has a first and second open leg channel, each open leg channel being formed between a pair of leg channel walls. Each of the open leg channels has a width of approximately the thickness of the box blank so that one of the end walls is frictionally held inside one of the open leg channels of a corner enhancer and one of the side walls is frictionally held inside the other open leg channel of the corner enhancer. In this manner, each corner enhancer functions to join together an end wall and a side wall in an orthogonal or right angle relationship. These corner enhancers hold the side and end walls of the box together, without the need for mechanical fasteners.

In order to assemble the tote box of the present invention the box blank is erected and the side and end walls of the erected box blank inserted into the open leg channels of the corner enhancers. A side edge of each side wall and a corresponding side edge of an adjacent end wall are located inside the open leg channels of each of the corner enhancers in order to hold and maintain the walls in an erect vertical position, orthogonal to each other. Once the box blank has been folded and the walls of the box blank inserted into the open leg channels of the corner enhancers at the corners of the box, the corner pieces of the top rail are then snapped in place over the corner enhancers and the side and end pieces of top rail snapped over the upper edges of the box walls.

In an alternative embodiment of the present invention, the top rail is a unitary member rather than a multiple piece top rail. The unitary top rail is preferably manufactured from a single piece of extruded plastic or aluminum. However, the top rail may be constructed of other materials such as steel, for example, and may be produced using other methods.

In another alternative embodiment of the present invention, a plurality of inserts are fitted inside the downwardly open channel of the top rail between the top rail and the box walls. Each of the inserts has a downwardly directing opening defined by a top and a pair of spaced legs extending downwardly from the top. At least one of the legs has an inwardly extending hook engaging the groove formed in the respective box wall and thereby locking the insert over the upper edge of the box wall. An inwardly extending hook of the top rail engages a ledge extending outwardly from the insert, thereby locking the top rail over the insert. This embodiment enables a top rail having a relatively large downwardly open channel to a box wall of a thickness less than the width of the downwardly open channel of the top rail.

One advantage of the present invention is that the tote box can be assembled rapidly without the need for intermediate fastener joining steps and without the need for multiple rivets or fasteners such as have been conventional in prior art tote boxes as, for example, in the tote box disclosed in the assignee's own earlier U.S. Pat. No. 5,037,027.

Another advantage of the present invention is that the stackable tote box may be constructed of thicker material more quickly and less expensively than is presently possible in competitive type tote boxes.

BRIEF DESCRIPTION OF THE DRAWINGS

The objectives and features of the present invention will become more readily apparent when the following detailed description of the drawings is taken in conjunction with the accompanying drawings in which:

FIG. 1B is a partially disassembled perspective view of a corner piece of the top rail being secured to adjacent tote box walls and one end piece and one side piece of the top rail being secured to the corner piece of the top rail.

DETAILED DESCRIPTION OF THE DRAWINGS

Figure 1:
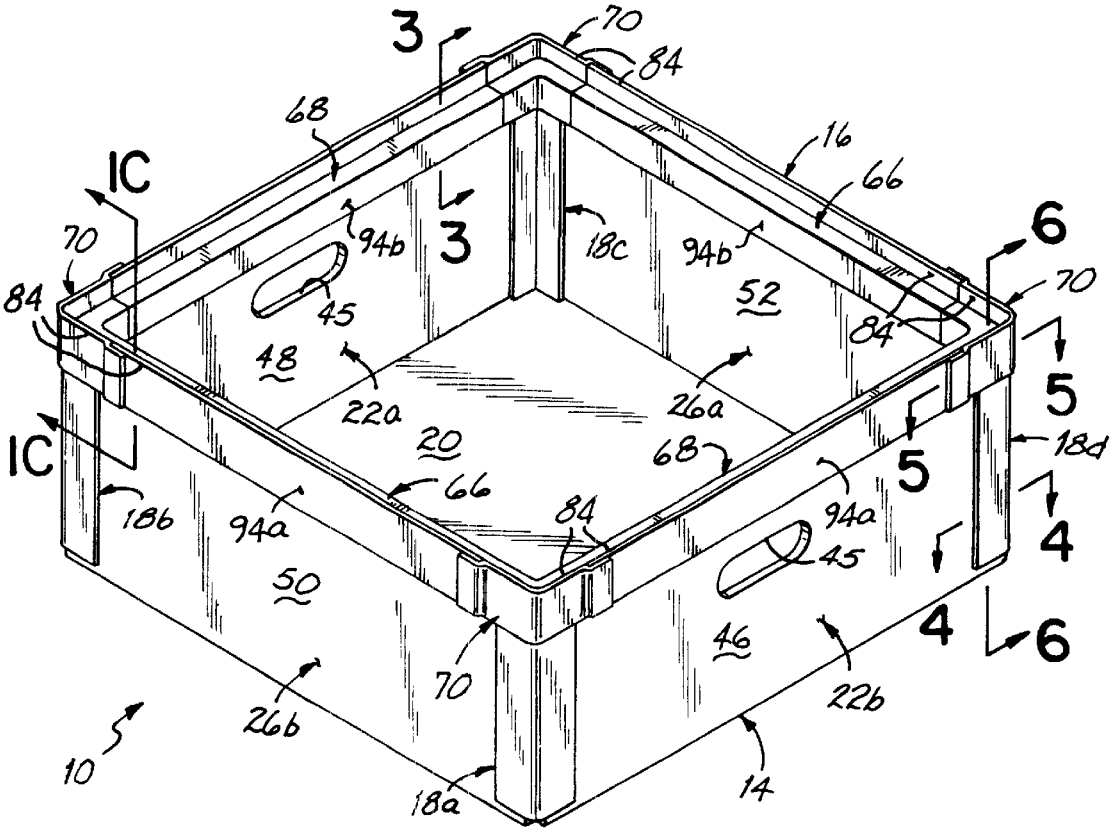
FIG. 1 is a perspective view of one preferred embodiment of the assembled tote box of the present invention.
Figure 2:
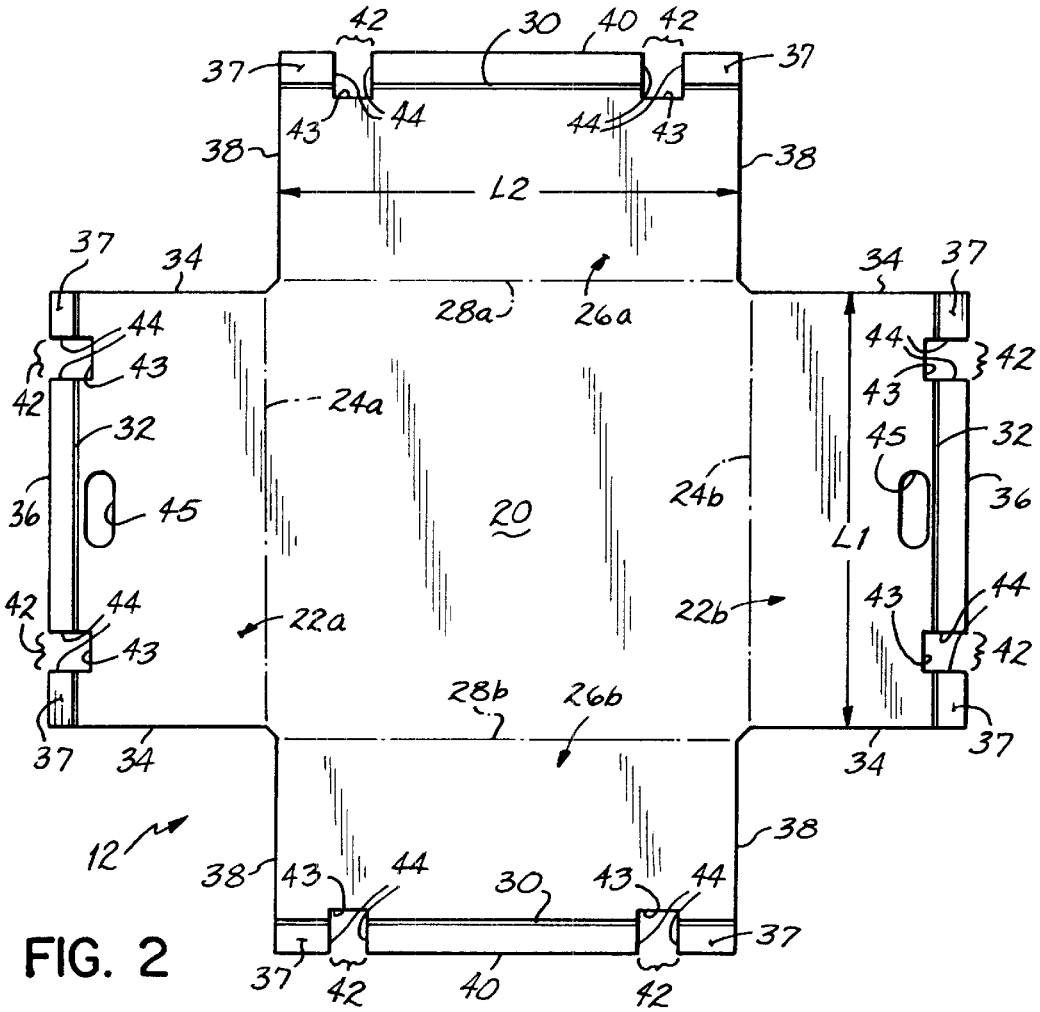
FIG. 2 is a top plan view of a box blank used to form the tote box of FIG. 1.

Referring to FIG. 1, there is illustrated an assembled tote box 10 according to the present invention. The tote box 10 is assembled from a uniform thickness box blank 12 as seen in FIG. 2 which is die cut or otherwise pre-cut from, preferably, corrugated plastic sheet. However, the box blank and resulting box may be made from any other suitable material. In one preferred embodiment, the box blank 12 is 10 millimeters thick and made from extruded corrugated plastic material. Depending upon the application, the box blank may be other thicknesses or materials as well.

Figure 1C:
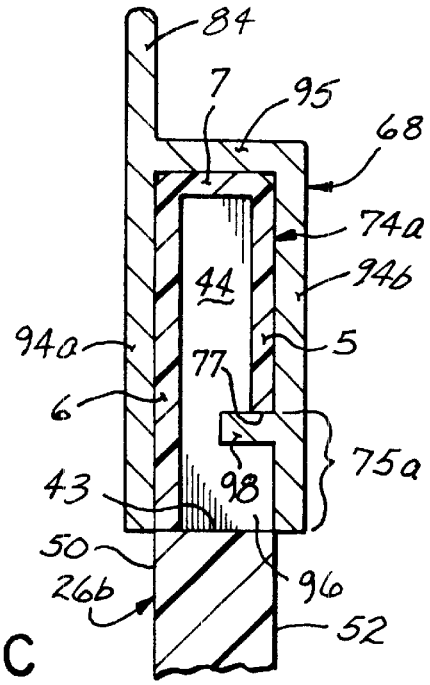
FIG. 1C is a cross-sectional view taken along the line 1C—1C of FIG. 1.
Figure 1A:
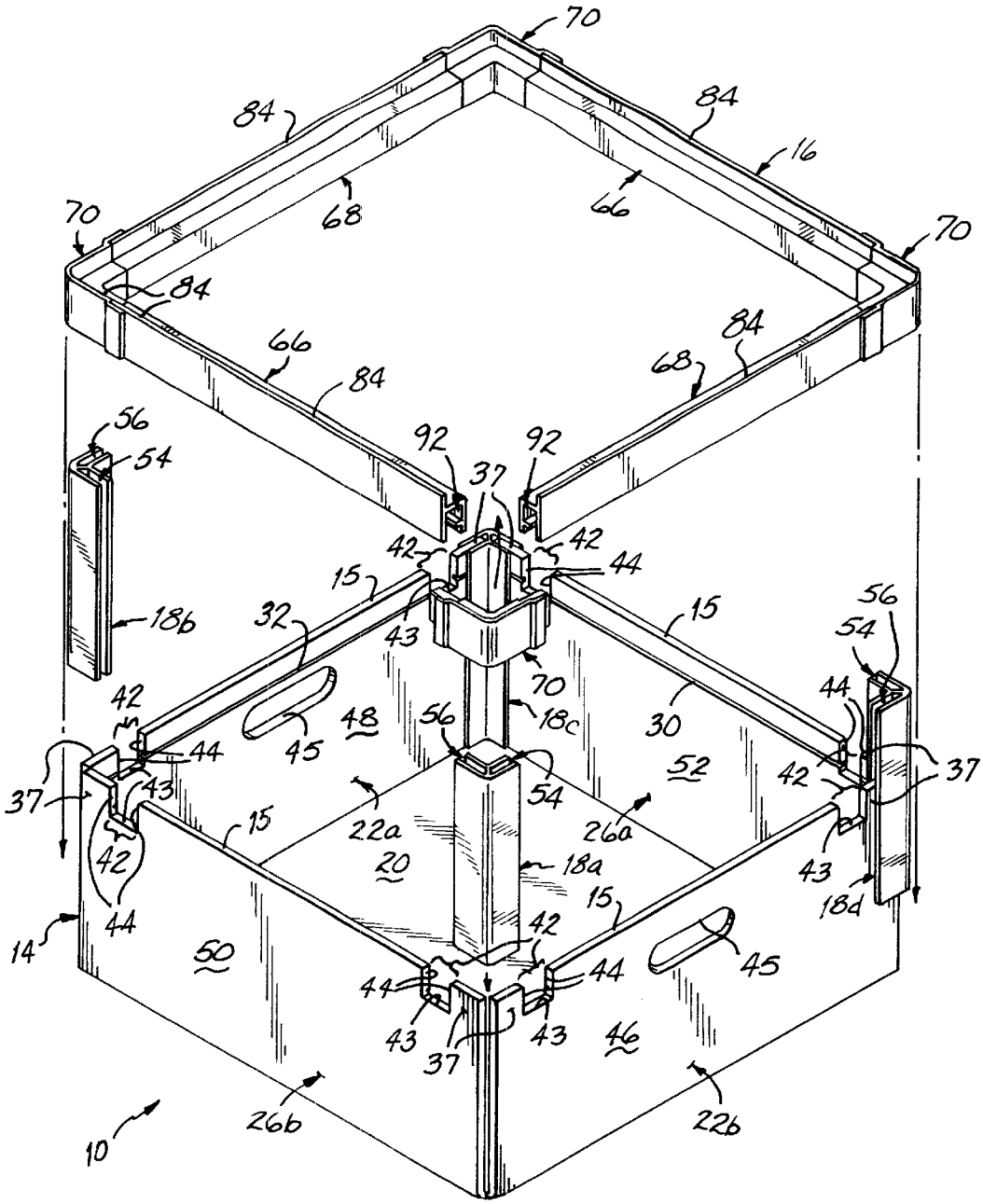
FIG. 1A is a partially disassembled perspective view of the tote box of FIG. 1.

As best illustrated in FIG. 1A, the tote box 10 comprises a box 14 formed from the foldable box blank 12 (shown in FIG. 2), a multiple piece top rail 16, and four corner enhancers 18*a*–18*d*.

Referring to FIGS. 1A and 2, the box blank 12 is folded along fold lines to form a box 14 illustrated in FIG. 1A. As best illustrated in FIG. 2, the box blank 12 has a bottom 20, two end walls 22*a* and 22*b* connected to the bottom with fold lines 24*a* and 24*b*, two side walls 26*a*, 26*b* connected to the bottom 20 by fold lines 28*a*, 28*b*.

In one preferred embodiment, each of the side walls 26*a,* 26*b* has a horizontally extending groove 30 which extends the length of the side wall. Similarly, in this embodiment, each of the end walls 22*a,* 22*b* has a horizontally extending groove 32 which extends the length of the end wall (see FIG. 2). It is within the contemplation of the present invention that only two opposed walls have horizontally extending grooves. It is also within the contemplation of the present invention that the side walls or end walls have any number of grooves at various locations. This application is not intended to limit the number, location or configuration of the grooves 30, 32 formed in the side and end walls, respectively.

As best illustrated in FIG. 2, each end wall 22*a,* 22*b* has a pair of opposed side edges 34 and an upper edge 36. Similarly, each of the side walls 26*a,* 26*b* has a pair of opposed side edges 38 and an upper edge 40.

As best illustrated in FIGS. 1A, 1B and 2, each of the walls has a pair of spaced rectangular cutouts 42 extending downwardly from the upper edge of the wall. Each cutout 42 is defined by a lower edge 43, and a pair of side edges 44. The size and location of the cutouts 42 may vary depending upon the desired application. An outer portion 37 of the wall outside each cutout 42 is adapted to fit inside a corner piece of a multiple piece top rail 16 in a manner which will be described in more detail below.

As best illustrated in FIG. 2, each of the opposed end walls 22*a, b* has an identical first length L1, and each of the opposed side walls 26*a, b* has an identical length L2. In one preferred embodiment of the present invention illustrated in FIG. 2, the lengths L1, L2 of the end walls 22*a, b* and side walls 26*a, b,* respectively are identical, resulting in a square box 14. However, for purposes of the present invention they may be of different lengths in order to create a rectangular box.

Oval shaped holes 45 are cut through the end walls 22*a,* 22*b* and may accommodate hand holds (not shown) which preferably are fabricated from plastic or aluminum but be constructed of any material. Although the holes 45 are illustrated as being formed in the end walls, they may alternatively be placed in the side walls 26*a*, 26*b* or in all four walls.

As best illustrated in FIG. 1A, once the end walls 22*a, b* of the box blank are folded along fold lines 24*a, b* into a generally vertical orientation, the ends walls 22*a,* 22*b* each have an outside surface 46 and an inside surface 48. Similarly, once the side walls 26*a, b* are folded along fold lines 28*a, b* each of the side walls 26*a,* 26*b* has an outside surface 50 and inside surface 52.

Figure 4:
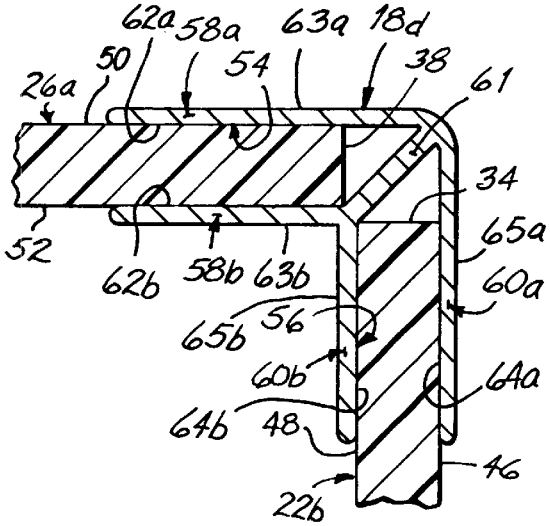
FIG. 4 is a cross-sectional view taken along the line 4—4 of FIG. 1.

Each of the corner enhancers 18*a*–18*d* is identically configured and has a first open leg channel 54 and a second open leg channel 56. FIG. 4 illustrates a cross-section through corner enhancer 18*d.* As best illustrated in FIG. 4, the first open leg channel 54 is formed between a pair of leg channel walls 58*a, b* and second open leg channel 56 is formed between a pair of leg channel walls 60*a, b.* The first and second open leg channels of each corner enhancer are separated by a separator 61. Leg channel wall 58*a* has an inside surface 62*a* and an outside surface 63*a,* respectively. Likewise, leg channel wall 58*b* has an inside surface 62*b* and an outside surface 63*b,* respectively. The distance between the inside surfaces 62*a* and 62*b* of leg channel walls 58*a, b* defines the width of the first open leg channel 54, which is approximately the thickness of the box blank 12. Likewise, the leg channel wall 60*a* of the second open leg channel 56 has an inside surface 64*a* and an outside surface 65*a,* respectively. Leg channel wall 60*b* of the second leg channel 56 also has an inside surface 64*b* and an outside surface 65*b.* The distance between the inside surfaces 64*a* and 64*b* of leg channel walls 60*a,* 60*b* defines the width of the second open leg channel 56, which is also approximately the thickness of the box blank 12.

Because the width of the first and second open leg channels are approximately equal and approximately equal to the thickness of the side and end walls of the box blank, one of the end walls 22*a, b* and one of the side walls 26*a, b* are frictionally held inside the open leg channels of each corner enhancer. One of the open leg channels of each corner enhancer receives one of an adjacent side wall and end wall while the other open leg channel of the corner enhancer receives the other one of the adjacent side wall and end walls.

For example, as illustrated in FIGS. 1A and 4, corner enhancer 18*d* joins together end wall 22*b* and side wall 26*a,* a portion of end wall 22*b* including side edge 34 being received within the second open leg channel 56 while a portion of side wall 26*a* including side edge 38 is received within the first open leg channel 54 of the corner enhancer 18*d.* Thus, each corner enhancer 18*a–d* functions to hold and maintain one of the end walls and one of the side walls in an orthogonal relationship in order to maintain the structural integrity of the box without the need for separate fasteners before the top rail 16 is placed over the box 14 and corner enhancers 18*a–d.*

Each corner enhancer 18*a–d* preferably has a height equal to the distance between the bottom 20 of box 14 and the top edge 15 of the box 14 (see FIG. 1A). However, corner enhancers of alternative heights may be used in accordance with the present invention.

Although one configuration of corner enhancer is illustrated and described, other configurations of corner enhancers may be used in accordance with the present invention. For example, each corner enhancer may comprise an "L-shaped" inner piece and an "L-shaped" outer piece held together, the distance between the inner and outer pieces defining a pair of open leg channels of a width approximately equal to the thickness of the box blank.

To assemble the box 14 illustrated in FIG. 1A from the box blank 12 illustrated in FIG. 2, the end walls 22*a,* 22*b* are first folded upwardly along fold lines 24*a,* 24*b,* respectively. Next, the side walls 26*a,* 26*b* are folded upwardly along fold lines 28*a,* 28*b,* respectively. Once the side walls and end walls are erected, at each corner one of the side walls 26*a, b* is inserted into one of the open leg channels of one of the corner enhancers and one of the end walls 22*a, b* is inserted into the other open leg channel of the corner enhancer in order to hold and maintain one of the end walls and one of the side walls in an orthogonal vertical orientation or position. Because each of the open leg channels has a width of approximately the thickness of the box blank, each of the end walls and side walls are frictionally held inside one of the open leg channels of one of the corner enhancers.

Once the side walls and end walls of the tote box are erected and partially inserted into the open leg channels of the corner enhancers, the final step in the assembly of the tote box is accomplished by locating the multiple piece top rail 16 over the top edge of the erected box. The top edge 15 of the tote box 14 is formed from upper edges 36 of end walls 22*a, b* and upper edges 40 of side walls 26*a, b,* respectively.

Figure 5:
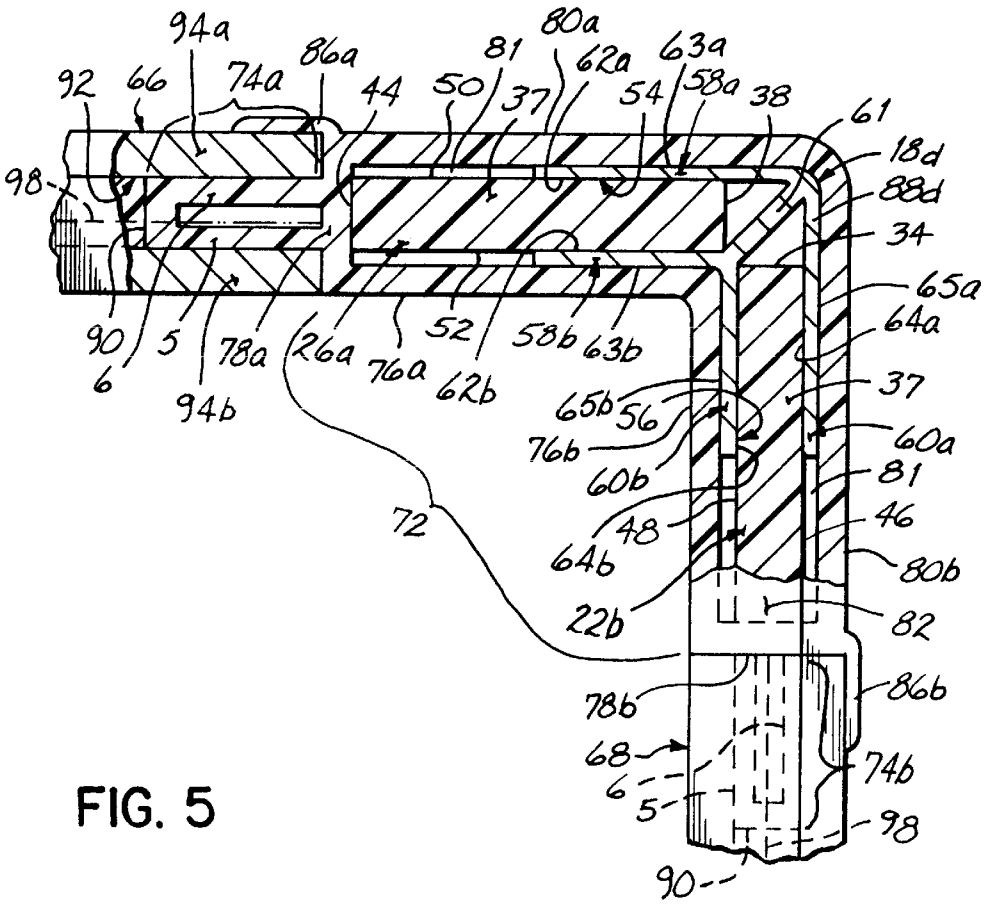
FIG. 5 is a cross-sectional view taken along the line 5—5 of FIG. 1.

As best illustrated in FIG. 1A one embodiment of the top rail 16 is made up of multiple pieces: a pair of opposed side pieces 66, a pair of opposed end pieces 68 and four corner pieces 70. As best illustrated in FIG. 1A, each corner piece 70 joins one side piece 66 to an adjacent end piece 68 of the top rail in an orthogonal relationship. As best illustrated in FIG. 1B, each corner piece 70 also functions to join one side wall to an adjacent end wall of the box 14 in an orthogonal relationship. Each corner piece 70 is preferably configured as shown in FIGS. 1B and 5. However other designs of corner pieces may be utilized in accordance with the present invention.

As shown in FIG.1B, each corner piece 70 has a central portion 72 and a pair of outer portions 74*a,* 74*b.* The central portion 72 comprises a pair of vertically oriented inner wall portions 76*a,* 76*b* which are generally perpendicular to each other, a pair of vertically oriented side wall portions 78*a,* 78*b,* a pair of outer wall portions 80*a,* 80*b* and a horizontally oriented top wall 82. The outer wall portions 80*a,* 80*b* extend vertically above the horizontally oriented top wall 82, creating a lip 84. The outer wall portions 80*a,* 80*b* each have an outer flange 86*a,* 86*b,* respectively extending outwardly beyond the vertically oriented side wall portions 78*a,* 78*b* of the central portion 72 of the corner piece 70. The central portion 72 of the corner piece 70 has a hollow interior 81 (See FIG. 5) defined by the inner wall portions 76*a,* 76*b,* the side wall portions 78*a,* 78*b,* the outer wall portions 80*a,* 80*b* and the horizontally oriented top wall 82. As seen in FIG. 5, the hollow interior 81 of the central portion 72 of the corner piece 70 is adapted to receive an upper portion 88 of one of the corner enhancers as well as one of the outer portions 37 of one of the side walls and one of the outer portions 37 of one of the end walls. FIG. 1B illustrates the hollow interior 81 of the central portion 72 of corner piece 70 receiving an upper portion 88*c* of corner enhancer 18*c* as well as the outer portions 37 of side wall 26*a* and end wall 22*a*.

As seen in FIG. 1B each outer portion 74*a,* 74*b* of each corner piece 70 comprises an inner wall portion 5, outer wall portions 6, top portion 7 and vertically oriented end wall 90. As seen in FIG. 1B, each outer portion 74*a,* 74*b* has an indented portion 75*a,* 75*b.* Each inner wall portion 5 terminates in a lower horizontally oriented stopping surface or ledge 77.

The outer portions 74*a,* 74*b* of the corner piece 70 are adapted to be received in cutouts 42 formed in the end and side walls of the box 14. The engagement of the side wall portions 78*a,* 78*b* of the central portion 72 of the corner piece 70 with the outermost side edges 44 of the cutouts 42 maintains adjacent walls in an orthogonal relationship and prevents the end and side walls of the box 14 from separating from the open leg channels 54, 56 of the corner enhancers 18*a–d* (See FIG. 5).

Of the multiple pieces of the top rail, the corner pieces 70 are the first pieces to be attached to the erected box. As illustrated in FIG. 1B, by lowering a corner piece 70 downwardly the upper portion 88*c* of the corner enhancer 18*c* and the outer portions 37 of the side and end walls 26*a,* 22*a* pass into the hollow interior 81 of the central portion 72 of the corner piece 70, thus providing structural stability to the corner and further preventing adjacent walls from separating from one another. Once all four corner pieces 70 of the top rail 16 are secured in place in this manner, the side pieces 66 and the end pieces 68 of the top rail are then moved downwardly and snapped into engagement with the corner pieces 70 of the top rail and the box walls in a manner described below.

Figure 3:
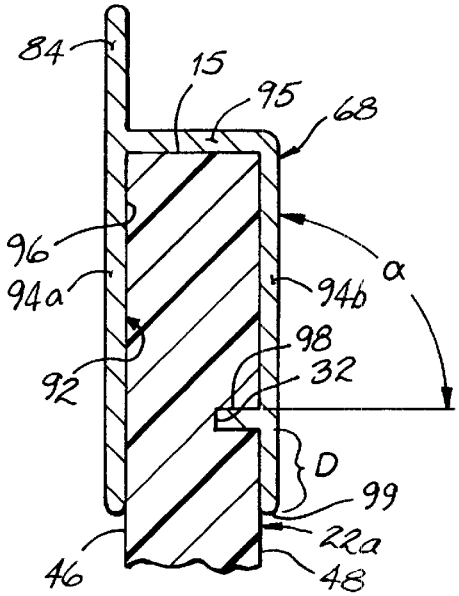
FIG. 3 is a cross-sectional view of a top rail and tote box wall taken on line 3—3 of FIG. 1.

As shown in FIG. 3, each side piece 66 and each end piece 68 of the top rail 16 has a downwardly open channel 92 which is formed between two spaced channel side walls 94*a, b* joined together with a top wall 95. The channel 92 has an opening 96 of a width of approximately the thickness of the box blank. As best seen in FIG. 3, a hook or projection 98 extends inwardly from the inner channel side wall 94*b.* The hook 98 preferably extends along the entire length of the side or end piece but may extend only partially the length of the top rail piece. The hook 98 is illustrated in FIG. 3 as extending inwardly perpendicular the vertically oriented channel side walls 94*a, b* of the downwardly open channel 92. This orientation is illustrated in FIG. 3 by the symbol a which is shown to be 90 degrees but may be any angular orientation.

As illustrated in FIG. 3, the inwardly extending hook 98 is provided a fixed distance D above the bottom 99 of channel side wall 94*b* in one preferred embodiment. The hook 98 may alternatively be placed at the bottom of channel side wall 94*a* or other locations on the inner channel side wall 94*b* to engage one of the grooves 30, 32 formed in one of the box walls. When the side piece 68 of the top rail 16 is snapped onto the erected tote box, hook 98 engages the groove 32 of the end wall 22*a* thereby securing the top rail piece 68 on the erected tote box as shown in FIG. 3. Once the side and end pieces of the top rail 16 are pressed onto the top edge of the tote box and the hooks 98 engage the grooves 30, 32 of the side and/or end walls, the tote box is erected without the benefit of mechanical fasteners, rivets, staples, or the like. The engagement of the hooks of at least two pieces of the top rail with at least two grooves formed in opposed walls of the erected box further prevent the pieces of the top rail from "rolling" outwardly off the upper edges of the box walls.

While the hooks 98 are illustrated in FIG. 3 as extending inwardly from the inside or inner channel side wall 94*b,* they could just as well be formed on the outside or outer channel side wall 94*a,* in which case the grooves would extend inwardly from the outside surface of the box walls.

As illustrated in FIG. 1C, the inwardly extending hook 98 formed on at least one channel side wall of the side and end pieces of the top rail preferably extends the entire length of the piece. Thus, as illustrated in FIGS. 1B and 5, the inwardly extending hooks 98 engage the stopping surfaces 77*a,* 77*b* formed in the outer portions 74*a,* 74*b* of the corner pieces 70 of the top rail (only one corner piece being illustrated in FIG. 1B). The engagement of the hook 98 of the side and end pieces of the top rail with the outer portions 74*a,* 74*b* of the corner pieces 70 of the top rail 16 prevents the side and end pieces of the top rail from separating from the erected box. Thus, if a piece of the top rail is not engaged with it corresponding groove, the top rail piece may not be pulled upwardly away from the tote box due to the engagement of the hook with the stopping surfaces 77*a,* 77*b* of the outer portions 74*a,* 74*b* of the corner pieces 70 located at the ends of the top rail side or end piece.

Figure 6:
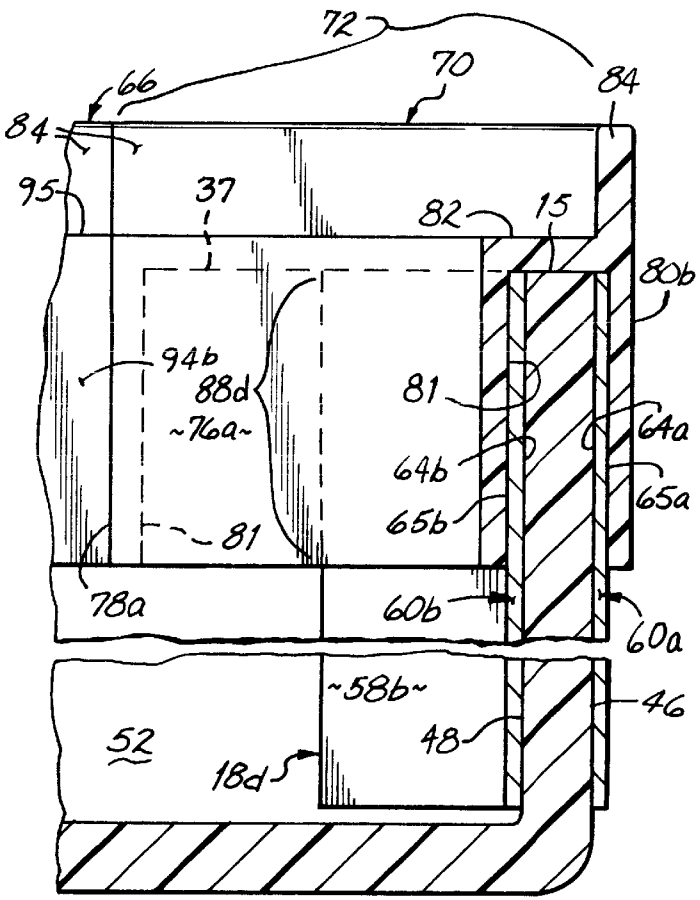
FIG. 6 is a cross-sectional view taken along the line 6—6 of FIG. 1.

As illustrated in FIGS. 5 and 6, each of the corner enhancers 18*a–d* has an upper portion 88*a–d* (only upper portion 88*d* being illustrated in FIGS. 5 and 6). These upper portions 88*a–d* of the corner enhancers 18*a–d* are located inside the hollow interiors 81 formed in the central portions 72 of the corner pieces 70 of top rail 16 as best illustrated in FIG. 6 and described above.

Each of the side pieces 66, end pieces 68 and corner pieces 70 of the top rail 16 of the present invention also has a vertically extending lip 84 on an outside upper edge thereof. The lip 84 facilitates the stacking of a second tote box in a nested relationship upon the tote box 10 of the present invention. The weight of the tote box stacked on the top rail 16 is distributed around the top rail 16 and supported by the corner enhancers 18*a–d* of the present invention. Although one configuration of top rail 16 is illustrated and described, the top rail 16 may assume other configurations as well, such as for example slots may be formed in the vertical lip 81 of the top rail 16 to receive strapping.

Figure 7:
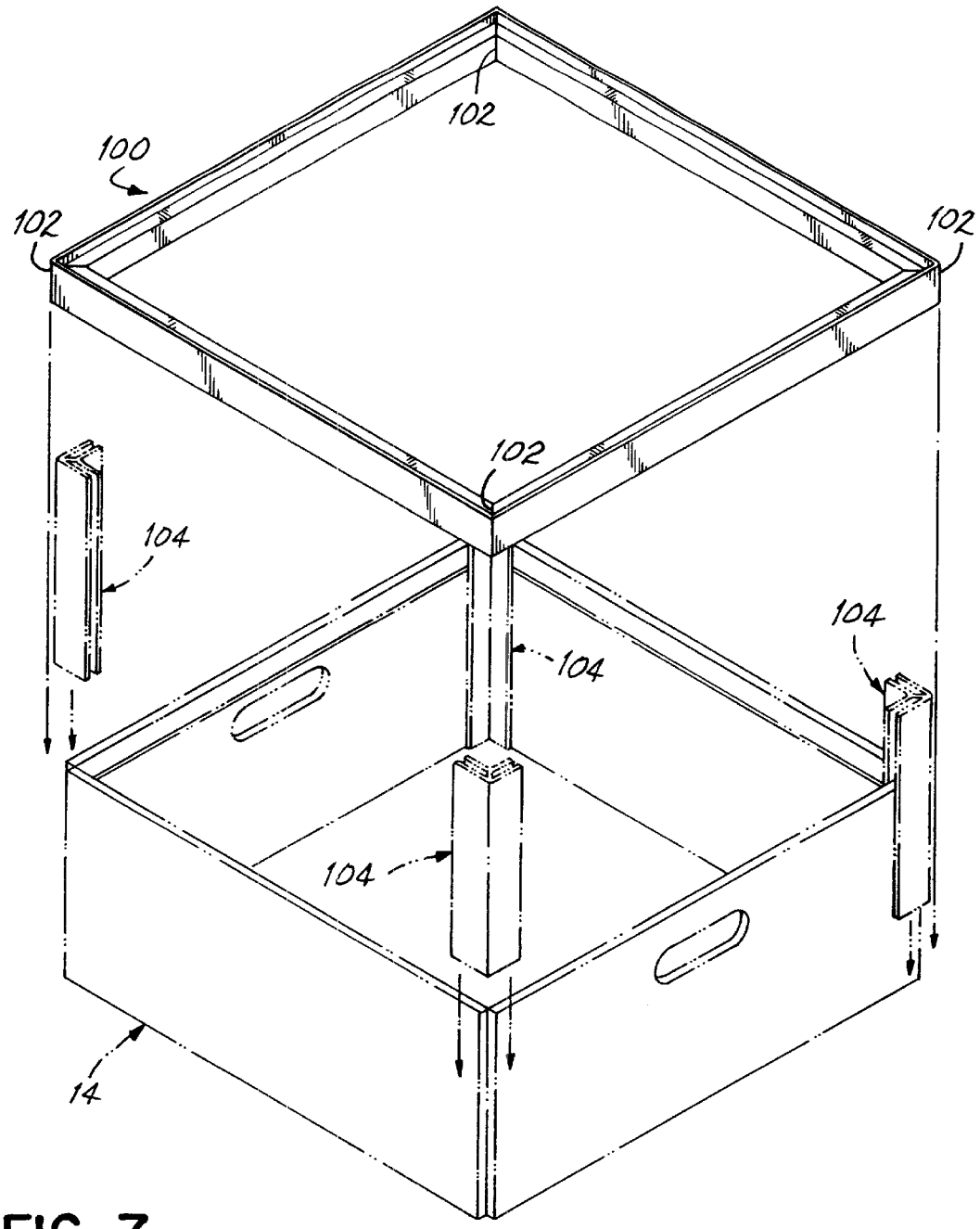
FIG. 7 is a partially disassembled perspective view of an alternative embodiment of tote box of the present invention having a unitary top rail.

FIG. 7 illustrates an alternative embodiment of the present invention in which the top rail is not made of multiple pieces but rather is a unitary member 100. This unitary top rail 100 may be notched at the corners 102. The unitary top rail 100 may be extruded from a single piece of plastic or aluminum but may be formed by alternative methods such as molding. Additionally, the top rail may be constructed of numerous materials and is not intended to be limited to any one material.

Preferably, the top rail is made of one piece of material having a pair of opposed ends. In order to create a generally rectangular top rail, the unitary piece of material is notched at four corners, folded at each corner notch and then the ends of the unitary piece of material are welded together to form the top rail which can then simply be snapped down over the erected tote box. Alternatively, the top rail may be constructed of multiple pieces of material welded or otherwise joined together. Preferably, the welds are at the corners of the top rail but may be located along the sides of the top rail.

Figure 8:
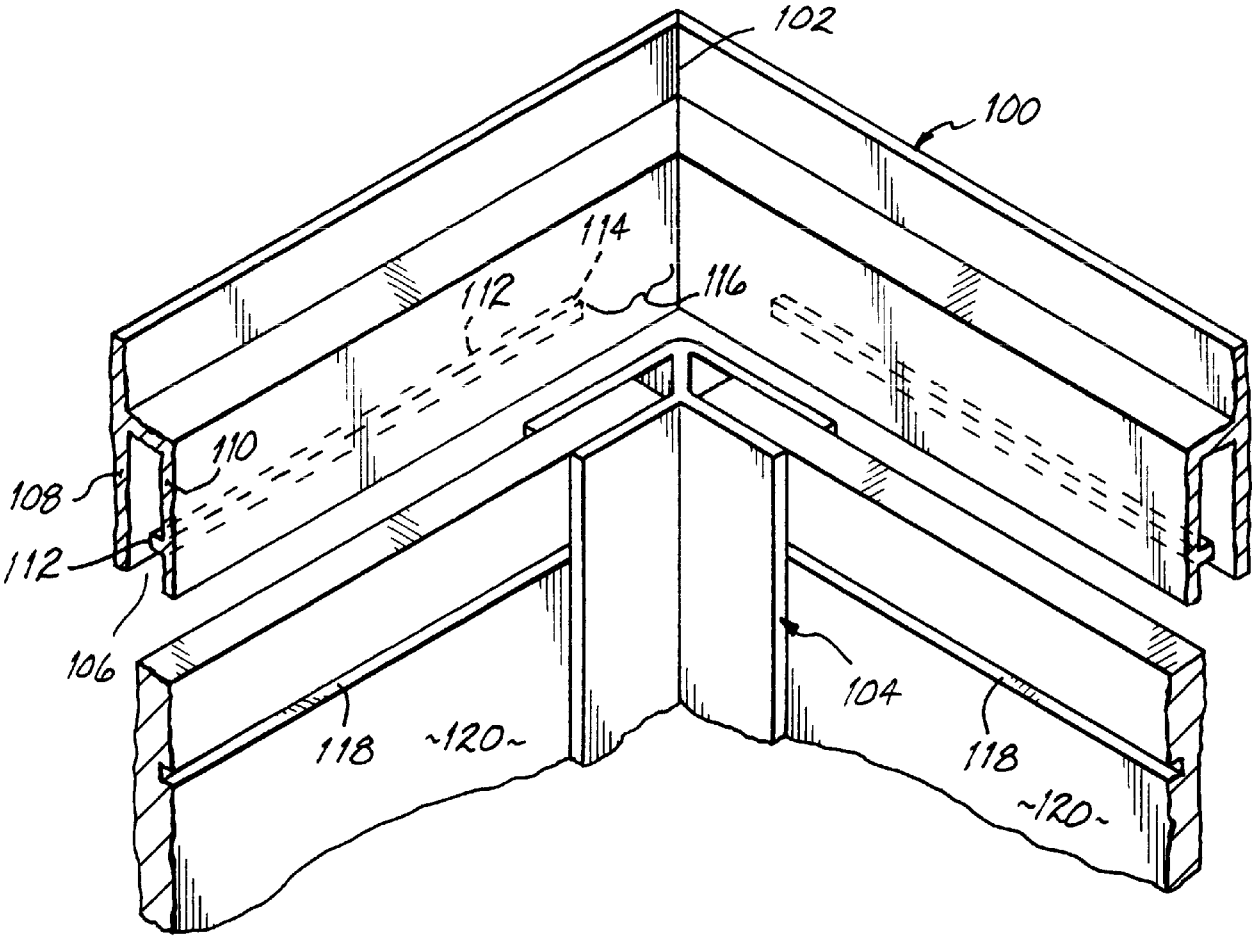
FIG. 8 is a partially disassembled perspective view of a portion of the unitary top rail of FIG. 7 being secured to adjacent tote box walls joined by a corner enhancer.

Referring to FIG. 8, at each corner 102 of the top rail 100, the top rail is modified to accommodate the presence of a corner enhancer 104. More specifically, the top rail 100 has a downwardly open channel 106 formed between a pair of channel side walls 108, 110 and an inwardly extending hook 112 extending inwardly from the inner channel side wall 110. Along each side of the top rail 100 the inwardly extending hook 112 stops at point 114, thus leaving a gap 116 adapted to accommodate the corner enhancer 104. Due to the presence of the corner enhancer 104, the grooves 118 formed in the extending inwardly from the inner surfaces 120 of the box walls are cut off by the corner enhancer 104. By limiting the length of the hooks along the of the top rail the corner enhancers do no interfere with the ability of the top rail to lock in place over the upper edges of the box walls with the inwardly extending hooks being engaged with the grooves of at least two box walls.

Figure 9:
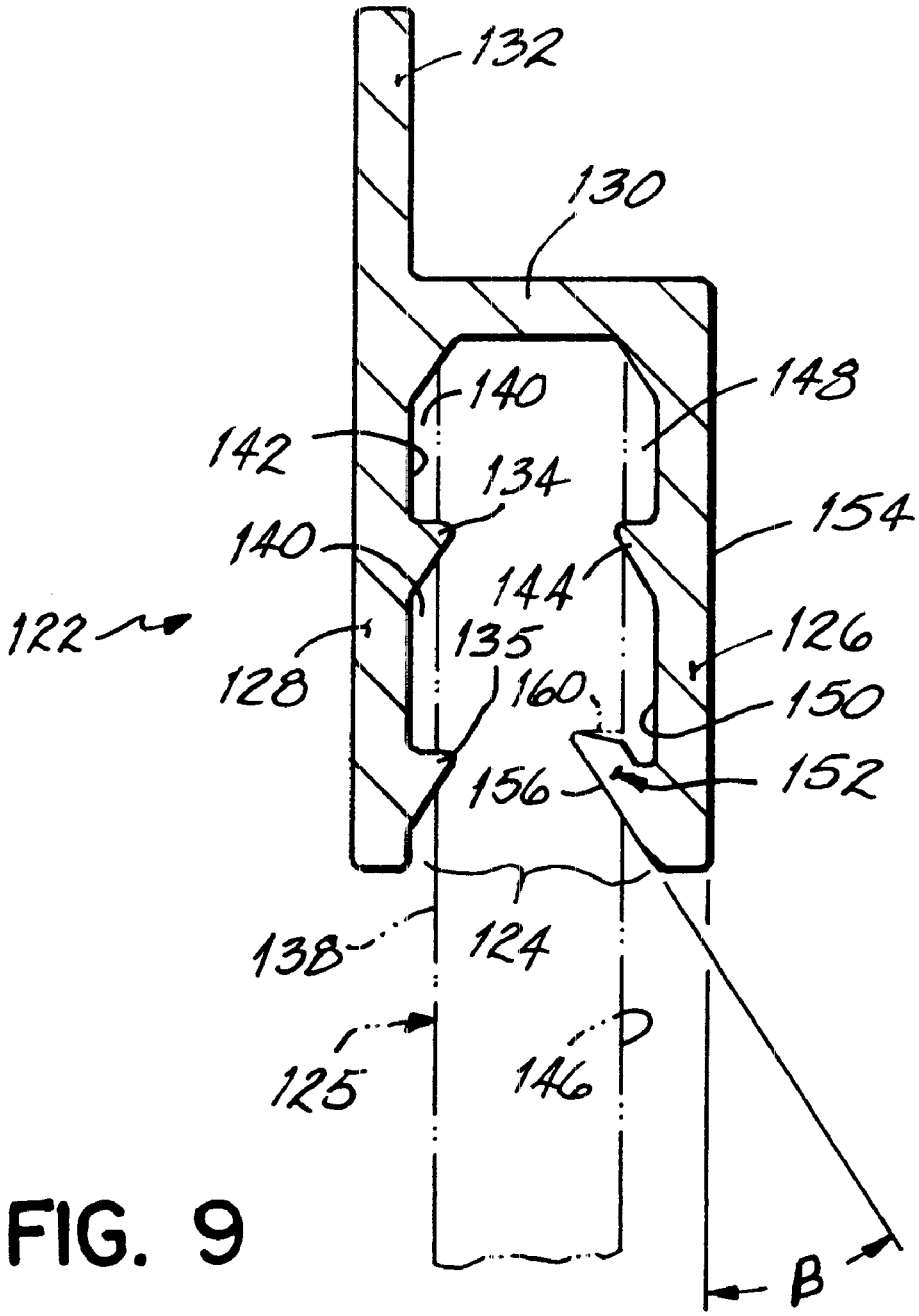
FIG. 9 is a cross-sectional view of an alternative embodiment of top rail.

FIG. 9 illustrates a cross-sectional view of an alternative embodiment of top rail made in accordance with the present invention. The top rail 122 illustrated in FIG. 9 has a downwardly open channel 124 adapted to receive a box wall illustrated in phantom. The downwardly open channel 124 is formed between an inner channel side wall 126 and an outer channel side wall 128 joined together by a top wall 130. A lip 132 extends upwardly from the outer channel side wall 128 above the top wall 130.

As illustrated in FIG. 9, each of the channel side walls 126, 128 has at least one projection adapted to engage the box wall 125. Outer channel side wall 128 has projections 134 and 135 extending inwardly from the outer channel side wall. These projections 134, 135 contact the outer surface 138 of the box wall 125, leaving gaps 140 between the outer surface 128 of the box wall 125 and an inner surface 142 of the outer channel side wall 128. Similarly, the inner channel side wall 126 has a projection 144 which contacts an inner surface 146 of the box wall 125, leaving gaps 148 between the inner surface 146 of the box wall 125 and an inner surface 150 of the inner box wall. The top rail 122 also has an inwardly extending hook 152 extending inwardly from the inner channel side wall 126 and integrally formed therein. The inwardly extending hook 152 projects upwardly and inwardly at an angle of β defined between an inner surface 154 of the inner channel side wall 126 and a linear outer surface 156 of the hook 152. This angle β is illustrated as being approximately 30° but may be any number of degrees, including 90, in which case the hook would extend inwardly orthogonally to the inner channel side wall 126. Although FIG. 9 illustrates the hook 152 located at the bottom of the inner channel side wall 126, the hook may be located anywhere along the length of either the inner channel side wall or the outer channel side wall. The hook 152 is adapted to be received in a groove 160 extending inwardly from the inner surface 146 of the box wall 125. The angle at which the groove 160 is formed is preferably identical to the angle β illustrated in FIG. 9 but may be other angles as well. Although only three projections 134, 135 and 144 are illustrated, any number of projections may be utilized in accordance with the present invention.

Although only one hook 152 is illustrated, more than one hook may extend inwardly from at least one of the channel side walls in order to lock the top rail over the box wall in accordance with the present invention.

Figure 10:
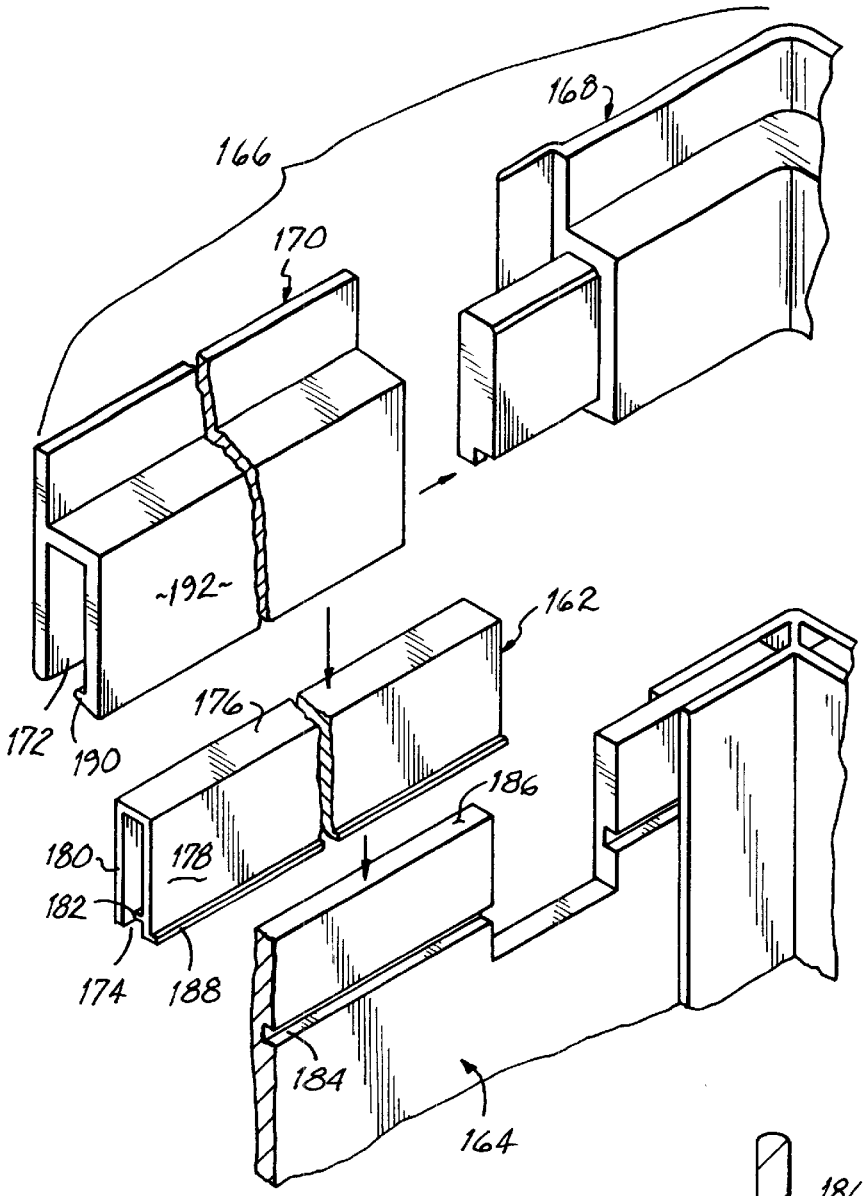
FIG. 10 is a perspective view partially broken away of another alternative embodiment of the present invention.

FIG. 10 illustrates an alternative embodiment of the present invention utilizing inserts 162 in order to help secure a top rail over a top edge of a box. Although one insert 162 is illustrated in FIG. 10 for purposes of simplicity, it will be understood that inserts 162 may be placed over two opposed box walls 164 in accordance with the present invention, or over all four walls of the box. Although FIG. 10 illustrates a top rail 166 having a corner piece 168 and a side piece 170 made in accordance with the present invention, it will be appreciated that this embodiment may be utilized with a unitary top rail or any other form of top rail made in accordance with the present invention.

Referring to FIG. 1A, each of the inserts is fitted inside the downwardly open channel 172 of the top rail and has a downwardly directed opening 174 adapted to receive the box wall 164. The opening 174 is defined by a top 176 and a pair of downwardly extending spaced legs 178 and 180. The inner leg 178 has a hook 182 extending inwardly therefrom engaged with a groove 184 formed in the side wall 164, thus locking the insert over the upper edge 186 of the box wall.

In order to prevent the top rail piece 170 from rolling outwardly and separating from the insert 162 and box wall 164, the downwardly extending leg 178 of the insert has an outwardly extending ledge 188 extending along its length. The ledge 188 is adapted to engage a hook 190 extending inwardly from the inner channel side wall 192. Although the hook 190 is illustrated at the bottom of the inner channel side wall 192, the hook 190 may be located anywhere along the height of the inner channel side wall 192.

Although the hook 190, ledge 188, insert hook 184 and groove 184 are illustrated as being on the inside of the box walls, they may alternatively be placed on the outside or both on the inside and outside of the box walls.

Thus, the present invention provides a quick and easy way to lock at least one piece of a multiple piece top rail or a unitary top rail over an erected box.

These and other objects and advantages of the present invention will be apparent to those skilled in the art. Therefore many modifications may be made without departing from the spirit and scope of the present invention. It is applicant's intention to be bound only by the scope of the following claims and not to be bound by the detailed specifics provided in the specification above.

I claim:

1. A tote box with a self-locking top rail comprising:

a box formed from a foldable box blank of a uniform thickness, said box having a bottom, two opposed side walls and two opposed end walls, said side walls and end walls having upper edges defining a top edge of the box, at least two of said side walls and end walls each having a groove extending horizontally below said upper edge of said box wall, and a top rail extending around the top edge of said box, said top rail having a downwardly open channel formed between a pair of channel side walls, said downwardly open channel being fitted over said upper edges of said side walls and said end walls, at least one of said channel side walls having an inwardly extending hook, said inwardly extending hook engaging said grooves and locking said top rail over said upper edges of said end and side walls.

2. The tote box of claim 1 wherein said tote box has a plurality of corner enhancers, each of said corner enhancers having first and second open leg channels, each open leg channel being formed between a pair of leg channel walls, each of said open leg channels having an uninterrupted width defined between inside surfaces of said leg channel walls, said width of said open leg channels being substantially the same as the thickness of said box blank, one of said end walls being located inside one of said first and second open leg channels and one of said side walls being located inside the other of said first and second open leg channels.

3. The tote box of claim 2 wherein said top rail comprises multiple pieces.

4. The tote box of claim 1 wherein said foldable box blank is made of corrugated plastic sheet.

5. The tote box of claim 1 wherein said inwardly extending hook extends inwardly from an inner channel side wall of said top rail.

6. The tote box of claim 1 wherein said top rail has a vertical lip on an outside upper edge thereof for facilitating stacking of a second tote box on top of said tote box.

7. A tote box with a self-locking top rail comprising:

a box formed from a foldable box blank of a uniform thickness, said box having a bottom, two opposed side walls and two opposed end walls, said side walls and end walls having upper edges defining a top edge of the box, said side and end walls of said box having grooves therein, a plurality of corner enhancers, each of said corner enhancers joining one of said end walls to one of said side walls, each of said corner enhancers having first and second open leg channels each formed between a pair of leg channel walls, each of said open leg channels having a width defined between planar inside surfaces of said leg channel walls, said width of said open leg channels being substantially the same as the thickness of said box blank so as to hold inside said first and second open leg channels one of said side walls and one of said end walls, and a top rail extending around the top edge of said box, said top rail having a downwardly open channel formed between an inner channel side wall and an outer channel side wall, said inner channel side wall having an inwardly extending hook extending inwardly and upwardly from said inner channel side wall, said downwardly open channel being fitted over said upper edges of said side walls and said end walls, said inwardly extending hook engaging said grooves of said side and end walls of said box, interengagement of said inwardly extending hook of said top rail with said grooves of said walls preventing said top rail from rotating off said top edge of said box.

8. The tote box of claim 7 wherein said inwardly extending hook extends upwardly from said inner channel side wall.

9. The tote box of claim 7 wherein each of said grooves extends upwardly from an inside surface of one of said box walls.

10. The tote box of claim 7 wherein said foldable box blank is made of corrugated plastic sheet.

11. The tote box of claim 7 wherein said top rail has a vertical lip on an outside upper edge thereof for facilitating stacking of a second tote box on top of said tote box.

12. The tote box of claim 7 wherein said inwardly extending hook has an angle of 90 degrees relative to an inside surface of said inner channel side wall.

13. A tote box with a self-locking top rail comprising:

a box formed from a foldable box blank, said box having a bottom, two opposed side walls and two opposed end walls, said side walls and end walls having upper edges defining a top edge of the box, at least two of said walls having a horizontally oriented groove, a plurality of corner enhancers, each of said corner enhancers having first and second open leg channels, each open leg channel being formed between a pair of leg channel walls, each of said open leg channels having an uninterrupted width defined between planar inside surfaces of said leg channel walls, one of said end walls being located inside one of said first and second open leg channels and one of said side walls being located inside the other of said first and second open leg channels, and a top rail extending around the top edge of said box, said top rail comprising two side pieces, two end pieces and four corner pieces, each of said side pieces and each of said end pieces of said top rail having a downwardly open channel formed between a pair of channel side walls, said downwardly open channel being fitted over said upper edges of said side walls and said end walls of said box, at least two of said pieces of said top rail having a hook extending inwardly from at least one of said channel side walls for engaging said grooves and locking said pieces over said upper edges of said box walls.

14. The tote box of claim 13 wherein each of said grooves extends upwardly from an inside surface of one of said box walls.

15. The tote box of claim 13 wherein each of said grooves extends upwardly from an inside surface of one of said box walls.

16. The tote box of claim 13 wherein said pieces of said top rail have a vertical lip on an outside upper edge thereof for facilitating stacking of a second tote box on top of said tote box.

17. The tote box of claim 1 wherein said grooves extend approximately half way through said walls of said box.

18. A tote box with a self-locking top rail comprising:

a box formed from a foldable box blank of a uniform thickness, said box having a bottom, two opposed side walls and two opposed end walls, said side walls and end walls having upper edges defining a top edge of the box, at least two of said box walls each having a groove extending horizontally below said upper edge of said box wall, four corner enhancers, each corner enhancer joining one of said end walls to one of said side walls, each corner enhancer having first and second open leg channels each formed between a pair of leg channel walls, each of said open leg channels having an uninterrupted width defined between inside surfaces of said leg channel walls, said width of said open leg channels being substantially the same as the thickness of said box blank so as to receive inside said first and second open leg channels one of said side walls and one of said end walls, and a top rail extending around the top edge of said box, said top rail comprising a pair of side pieces, a pair of end pieces and four corner pieces, each of said corner pieces joining one of said end pieces and one of said side pieces, each of said side and end pieces of said top rail having a downwardly open channel formed between a pair of channel side walls, said downwardly open channel being fitted over said upper edges of said box walls, at least one of said channel side walls having an inwardly extending hook for engaging one of said grooves and locking said top rail over said top edge of said box.

19. The tote box of claim 18 wherein said pieces of said top rail have a vertical lip on an outside upper edge thereof for facilitating stacking of a second tote box on top of said tote box.

20. A tote box comprising:

a box formed from a foldable box blank, said box having a bottom, two opposed side walls and two opposed end walls, said side walls and end walls having upper edges defining a top edge of the box, at least two of said walls having horizontally extending grooves below said upper edges of said box walls, and a top rail extending around the top edge of said box, said top rail comprising multiple pieces, at least two of said pieces having a downwardly open channel formed between a pair of channel side walls, said downwardly open channel being fitted over said upper edges of said walls, at least one of said channel side walls having an inwardly extending hook, said inwardly extending hook engaging said grooves to prevent said top rail from separating from box walls.

21. A method of assembling a tote box with a self-locking top rail comprising four corner pieces, two end pieces and two side pieces, each of said end pieces and each of said side pieces of said top rail comprising a downwardly open channel formed between a pair of channel side walls, at least one of said channel side walls having an inwardly extending hook, said method comprising:

folding a box blank into a box, said box having a bottom, two opposed side walls and two opposed end walls, said side walls and end walls having upper edges defining a top edge of the box, each of said walls having at least one horizontally oriented groove located below said upper edge of said box wall, locating portions of said side and end walls of said box inside first and second open leg channels of corner enhancers, each of said open leg channels being formed between a pair of leg channel walls, and securing said top rail over said top edge of said box by pushing said end and side pieces of said top rail over said upper edges of said box walls until said inwardly extending hooks engage said grooves of said box walls.

22. The method of claim 21 wherein securing said top rail over said top edge of said box comprises securing four corner pieces of said top rail to said box, and placing said side and end pieces of said top rail over said top edge of said box.

23. A method of assembling a tote box with a self-locking top rail, said top rail comprising a downwardly open channel formed between a pair of channel side walls, at least one of said channel side walls having an inwardly extending hook, said method comprising:

folding a box blank into a box, said box having a bottom, two opposed side walls and two opposed end walls, said side walls and end walls having upper edges defining a top edge of the box, each of said walls having at least one horizontally oriented groove located below said upper edge of said box wall, locating portions of said side and end walls of said box inside first and second open leg channels of corner enhancers, each of said open leg channels being formed between a pair of leg channel walls, and pushing said top rail over said upper edges of said box walls until said inwardly extending hooks engage said grooves of said box walls.

24. A tote box with a self-locking top rail comprising:

a box formed from a foldable box blank of a uniform thickness, said box having a bottom, two opposed side walls and two opposed end walls, said side walls and end walls having upper edges defining a top edge of the box, at least two of said side walls and end walls each having a groove extending horizontally below said upper edge of said box wall, and a top rail extending around the top edge of said box, said top rail having a downwardly open channel formed between a pair of channel side walls, said downwardly open channel being fitted over said upper edges of said side walls and said end walls, a plurality of inserts fitted inside said downwardly open channel of said top rail, each of said inserts having a downwardly directed opening defined by a top and a pair of spaced legs extending downwardly from said top, at least one of said legs having an inwardly extending hook, said inwardly extending hook engaging said grooves and locking said inserts over said upper edges of said end and side walls.

25. The tote box of claim 24 wherein said tote box has a plurality of corner enhancers, each of said corner enhancers having first and second open leg channels, each open leg channel being formed between a pair of leg channel walls, each of said open leg channels having an uninterrupted width defined between inside surfaces of said leg channel walls, said width of said open leg channels being substantially the same as the thickness of said box blank, one of said end walls being located inside one of said first and second open leg channels and one of said side walls being located inside the other of said first and second open leg channels.

26. The tote box of claim 24 wherein said top rail comprises multiple pieces.

27. The tote box of claim 24 wherein said foldable box blank is made of corrugated plastic sheet.

* * * * *

UNITED STATES PATENT AND TRADEMARK OFFICE

CERTIFICATE OF CORRECTION

PATENT NO. : 6,460,724 B1
DATED : October 8, 2002
INVENTOR(S) : Judson A. Bradford It is certified that error appears in the above-identified patent and that said Letters Patent is hereby corrected as shown below:

Column 2,
Line 21, replace “have holes” with -- has holes --.

Column 5,
Line 38, replace “but be” with -- but may be --.

Column 6,
Line 7, replace “width” with -- widths --.

Column 8,
Line 11, replace “symbol a which” with -- symbol ∝ which --.
Line 30, replace “prevent” with -- prevents --.
Line 51, replace “it” with -- its --.

Column 9,
Line 37, after “formed in the”, add the words -- box walls and --.
Line 40, after “along the”, add the word -- sides --.
Line 41, replace “do no” with -- do not --.

Figure 10A:
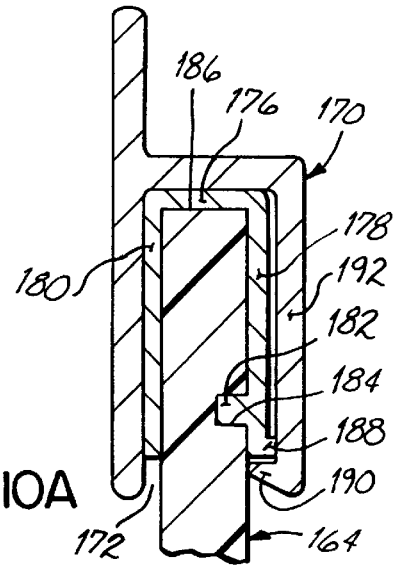
FIG. 10A is an assembled cross-sectional view of one side of the tote box of the embodiment illustrated in FIG. 10.

Column 10,
Line 35, replace “FIG. 1A,” with -- FIG. 10A, --.

Signed and Sealed this

Fifth Day of August, 2003

JAMES E. ROGAN
*Director of the United States Patent and Trademark Office*